US005494277A

United States Patent [19]

Flores

[11] Patent Number: 5,494,277

[45] Date of Patent: Feb. 27, 1996

[54] UNIVERSAL PAPER FEED

[75] Inventor: Armando V. Flores, Lexington, Ky.

[73] Assignee: Lexmark International, Inc., Greenwich, Conn.

[21] Appl. No.: 310,193

[22] Filed: Sep. 21, 1994

[51] Int. Cl.[6] ..... B65H 9/16

[52] U.S. Cl. ..... 271/251; 271/10.12

[58] Field of Search ..... 271/10.12, 250, 271/251

[56] References Cited

U.S. PATENT DOCUMENTS

| | | | |
|---|---|---|---|
| Re. 33,843 | 3/1992 | Naramore et al. | 271/251 |
| 4,179,117 | 12/1979 | Rhodes, Jr. | 271/251 |
| 4,775,142 | 10/1988 | Silverberg | 271/251 |
| 4,821,049 | 4/1989 | Eckl | 271/251 |
| 4,982,946 | 1/1991 | Uchimura et al. | 271/251 |
| 5,022,638 | 6/1991 | Ifkovits | 271/251 |
| 5,255,903 | 10/1993 | Parsons | 271/10.12 |

*Primary Examiner*—H. Grant Skaggs
*Attorney, Agent, or Firm*—John A. Brady

[57] ABSTRACT

A printer (1) has paper feed pinch rollers (21, 23 and 25, 27) with their backup rollers canted 5 degrees toward reference guide surface (19). Preceding idler roller (15) is also canted 1.5 degrees toward the guide surface. A sheet (3) fed by D roller (11) first encounters the idler roller and is moved toward the guide surface as a function of its stiffness. Very light sheet slip over the idler roller entirely, while heavier sheets are moved toward the guide surface by the idler roller. The pinch rollers direct all sheets toward guide surface but slip before deforming even very light paper.

4 Claims, 3 Drawing Sheets

UNIVERSAL PAPER FEED

TECHNICAL FIELD

This invention relates to sheet feeding in imaging apparatus. More specifically, this invention relates to the efficient feeding of sheets having a wide range of weights and consequent wide range of beam strength (stiffness).

BACKGROUND OF THE INVENTION

When feeding sheets against a reference edge, it is conventional to have rollers or other feeders canted toward the reference edge. Such feeding moves the sheet toward the reference surface, to thereby accurately position the sheet while primarily moving the sheet along the reference edge. Various designs of such feeders are known, such as illustrated in U.S. Pat. No. 4,982,946 to Uchimura.

Such prior designs, however, may not function well with a wide range of papers having different beam strength (stiffness). To positively move the heavier papers against the reference surface, the canted drivers must apply a force which will overcome the considerable drag which the heavier papers exhibit from passing over guide surfaces over which the papers passes during paper feed. When such strong forces are applied to light papers, the lighter papers are crushed against the reference edge surface and deformed. Consequently, current paper feeds in imaging apparatus are not universal, but instead feed sheets within a restricted range of stiffness. For example, paper feed which feed peel-off labels and card stock would not feed ordinary correspondence paper.

U.S. Pat. No. Re. 33,843 to Naramore et al and U.S. Pat. No. 4,179,117 to Rhodes, Jr. are feeders for a range of papers, termed here universal paper feeders. U.S. Pat. No. Re. 33,843 employs two idler rollers with an intermediate drive roller, all canted toward a reference surface. U.S. Pat. No. 4,179,117 employs backup and drive rollers in a nip, with the drive roller canted toward a reference edge and the backup roller canted away from the reference surface.

DISCLOSURE OF THE INVENTION

In accordance with this invention an imaging apparatus has paper feed drive apparatus canted toward a reference guide surface and an additional idler roller in the feed path prior to the drive members. The idler roller is also canted to move the paper toward the reference surface. The idler roller is suspended in space with its sheet-moving surface having no contact with any other sheet moving surface, and therefore is termed "isolated. In operation the sheet being fed encounters the idler roller and is influenced by it as a function of its beam strength. Very light sheets as in 16 lb. bond paper slide over the idler roller and are not influenced. Heavier sheets move the idler roller in an amount proportional to their beam strength. In that manner heavier papers are moved toward the reference surface to a greater degree than lighter papers. The canted drive members are designed to slip before applying force which would deform even very light paper. This paper feed functions well with a range of papers from very light to peel-off labels or card stock.

BRIEF DESCRIPTION OF THE DRAWING

The details of this invention will be described in connection with the accompanying drawing, in which.

BEST MODE OF CARRYING OUT THE INVENTION

Figure 1:
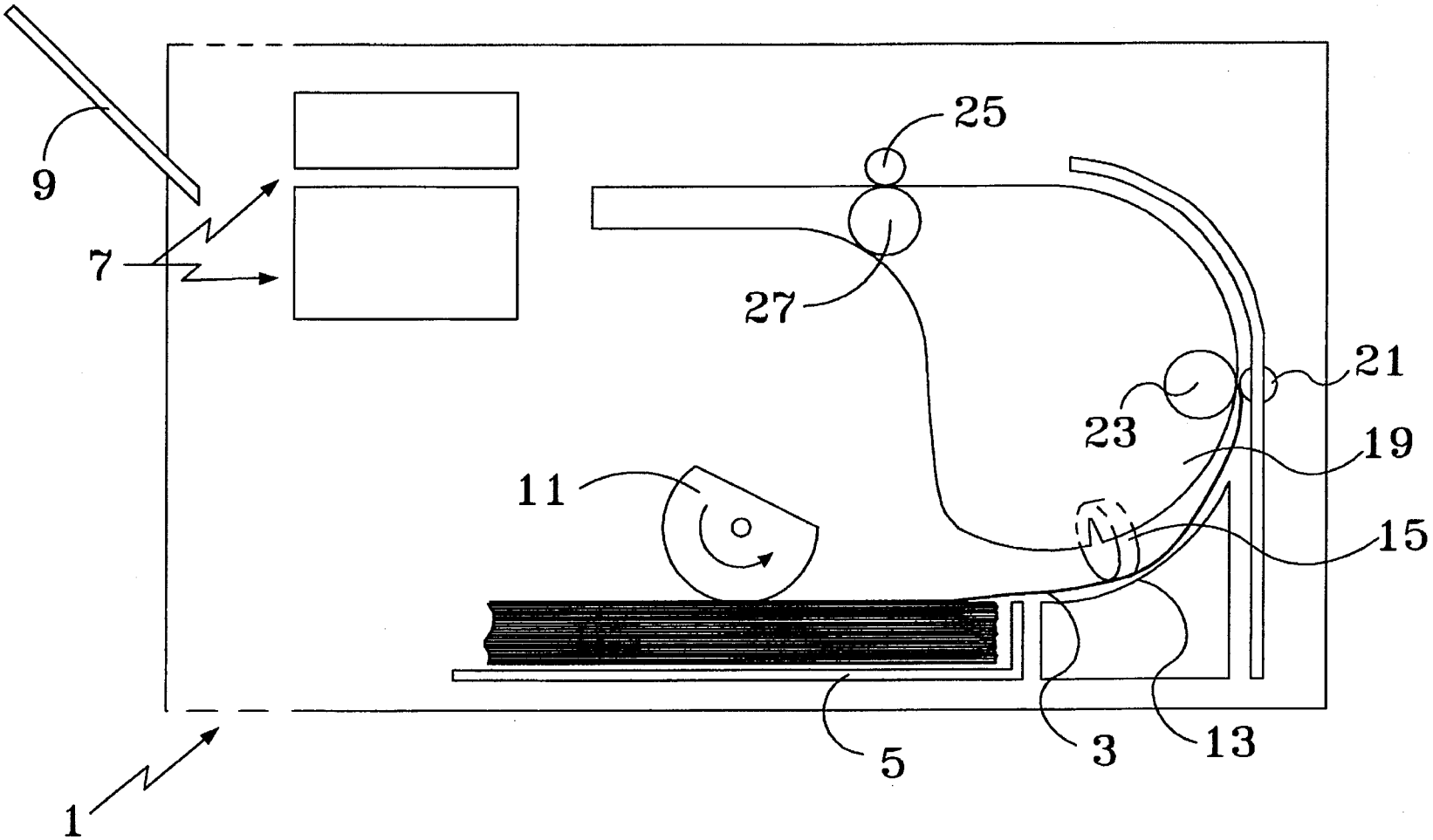
FIG. 1 is a side view of an illustrative printer which the novel elements significant to this invention shown in detail.

FIG. 1 shows a printer 1 having a sheet feed in accordance with this invention by which sheets 3, typically paper or laminations such as labels, are located in a lower tray 5, passes through printing mechanism 7 and then exits printer 1 to a tray 9, where it is accessible to an operator. As just described, printer 1 may be the 4039 laser printer sold commercially by the assignee of this invention.

Figure 2:
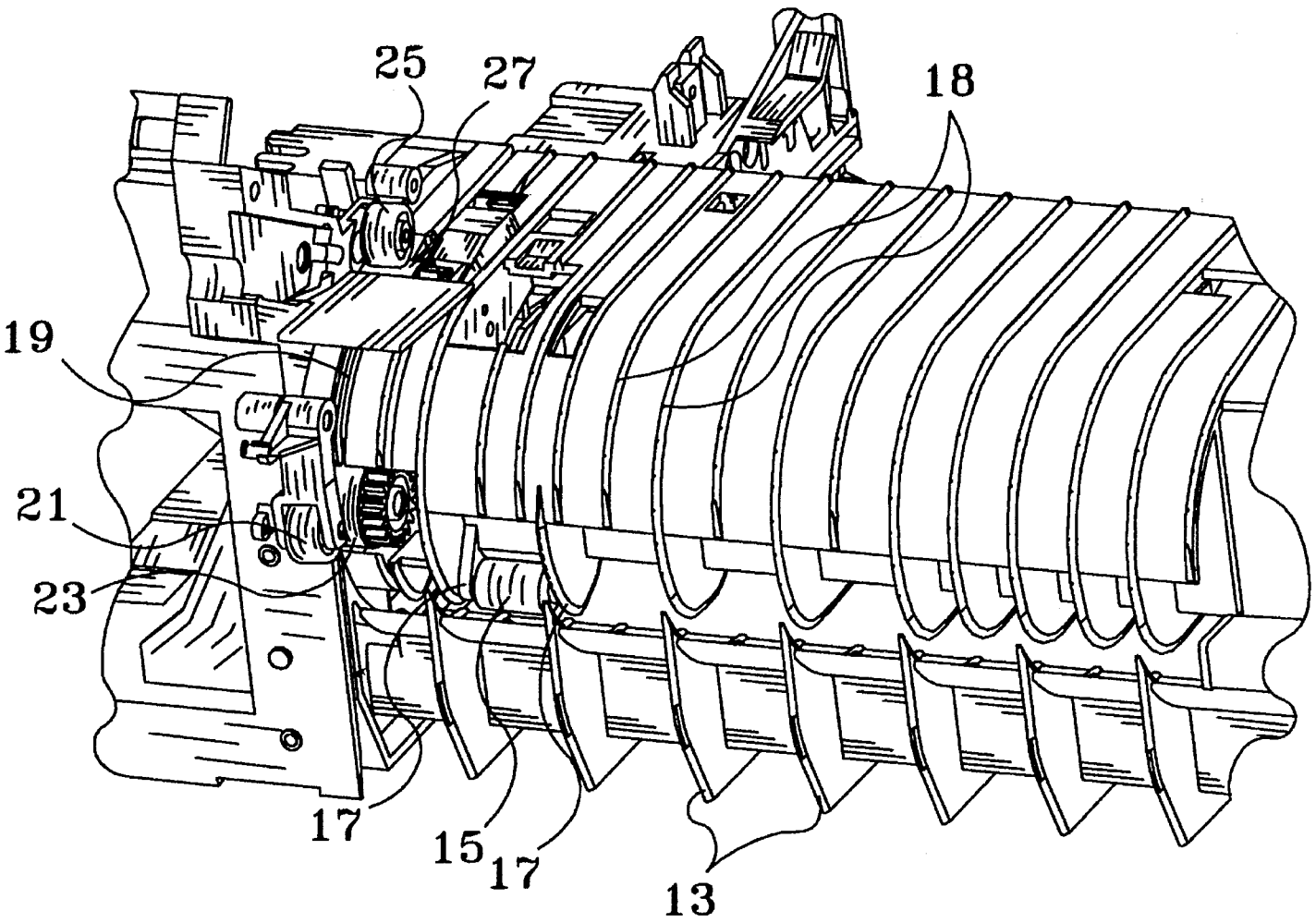
FIG. 2 is an orthogonal view from the back of FIG. 1 of the sheet feed of this invention in a printer.

To feed sheets 3, roller 11, widely termed a D roller, is rotated one revolution, as is conventional. Friction between roller 11 and the top sheet 3 moves sheet 3 out of tray 5 where it is guided upward by lower guide surface 13. Prior to encountering lower surface 13, sheet 3 encounters idler roller 15. Idler roller 15 is mounted in a stationary position by brackets 17 (FIG. 2) attached to upper guide 18 for rotation around its axis between brackets 17. Idler roller 15 has a cant of 1.5 degrees toward a side reference or boundary surface 19 (FIG. 2).

D roller 11 pushes the sheet 3 to encounter the lower segment of idler roller 15. Idler roller 15 has a moderate frictional surface which will not be moved by very light sheets 3, will be moved with some slippage by heavier papers in proportion to the stiffness of the sheets 3. Sheets 3 which are labels and very heavy papers do not slip at all on roller 15. To the extent that roller 15 rotates, the friction between roller 15 and sheet 3 transfers a force that moves sheet 3 perpendicular to the axis of roller 15, which is at 1.5 degrees from the reference surface 19. This moves the sheet 3 to the reference surface 19. Sheet 3 encounters nip rollers 21 and 23 and then nip rollers 25 and 27, each of which have a driven roller 23 and 27, respectively. Driven rollers 23 and 27 are directed parallel to reference surface 19. Backup rollers 21 and 25 are directed at 5 degrees (FIG. 3) toward the reference surface 19 to drive sheets 3 toward surface 19 while most movement is along surface 19.

Figure 3:
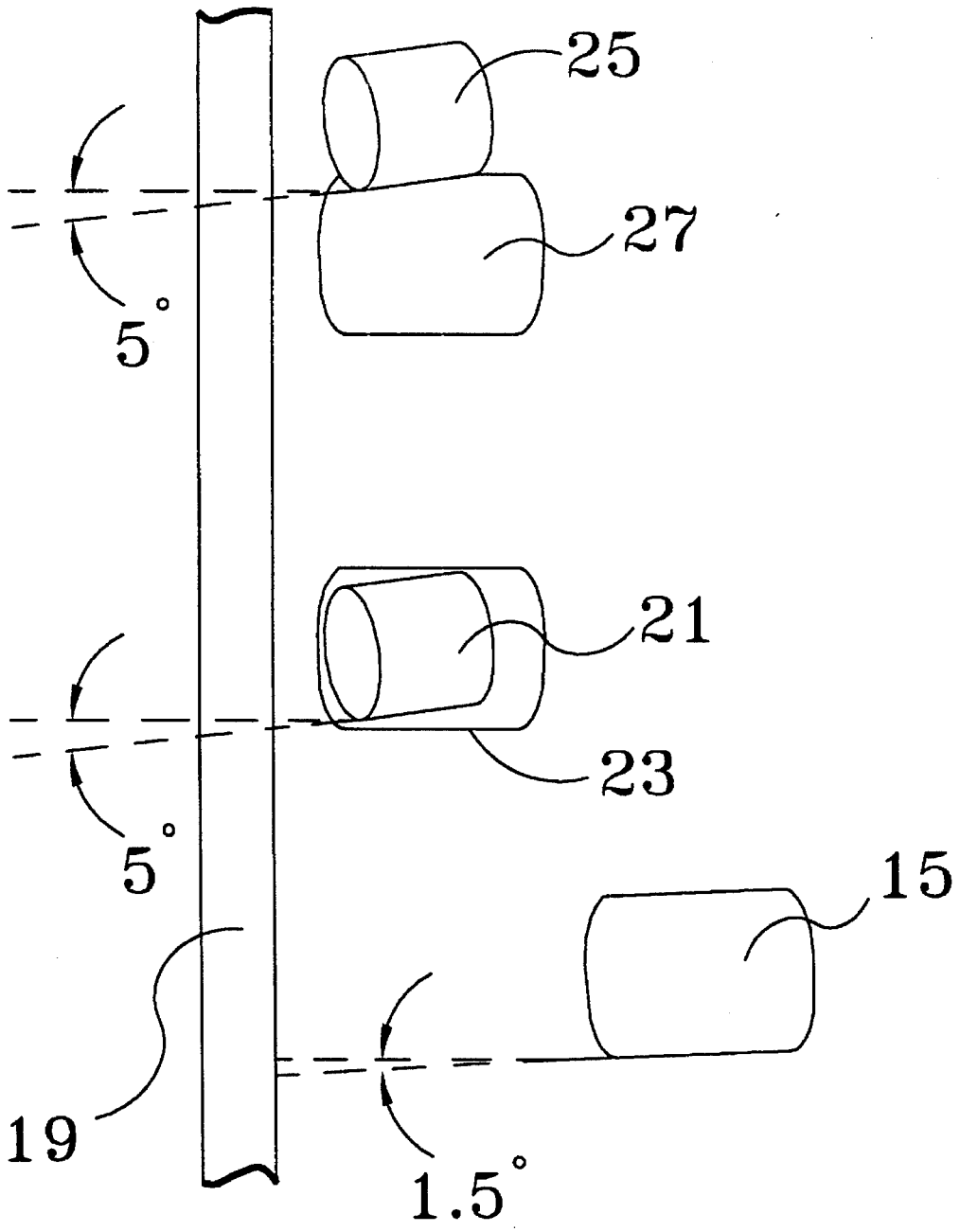
FIG. 3 is a view from the back of FIG. 1 of elements shown to be illustrative the cant of the rollers with respect to the paper reference surface.

As shown in FIG. 3 the idler roller 15 is at 1.5 degrees from the normal to the reference surface 19 and the backup rollers 21 and 25 are at 5 degrees from the normal to that surface 19. All of the rollers 15, 21, and 25 are thereby directed to move sheets 3 toward reference surface 19.

As is conventional, when a sheet 3 is fully against surface 19 sufficient slippage occurs so that all movement is along surface 19. The combination of rollers 21 and 23 and the combination of rollers 25 and 27 are lightly biased and not highly frictional so that they slip on sheets 3 before applying a force which would crush or deform even a sheet 3 of very low beam strength, while continuing to move sheets 3 parallel to reference surface 19. Without idler roller 15 such slippage would result in having some sheets 3 not being moved fully against reference surface 19. With idler roller 15 as described, the wide range of sheets 3 are all fed reliably against reference surface 19. Sheets 3 as light as 16 lb. bond paper slide over roller 15 and are not influenced by it. Peel-off labels or card stock cause roller 15 to move without any slippage.

Variations within the spirit and scope of the invention are anticipated.

What is claimed is:

1. A sheet feed apparatus comprising a reference surface to define a side boundary of sheets fed in said imaging apparatus, at least one driven feed apparatus to receive sheets and drive said sheets toward said reference surface and along said reference surface, said driven feed apparatus slipping on said sheets, including said sheets when of low beam strength, when they encounter said reference surface, an isolated idler roller located prior to said driven feed apparatus, said idler roller being canted toward said reference surface, and means to move sheets to first encounter said idler roller and to subsequently reach said driven feed apparatus to permit said sheets having frictional engagement with said idler roller to be moved toward said reference surface by said idler roller and to permit sheets which slip on said idler roller to be moved to said reference surface by said driven feed apparatus.

2. The sheet feed apparatus as in claim 1 in which said driven feed apparatus is at least one set of nip rollers having at least one roller canted toward said reference surface about 5 degrees from normal to said reference surface and said idler roller is canted toward said reference surface about 1.5 degrees from normal to said reference surface.

3. The sheet feed apparatus as in claim 2 in which said driven feed apparatus comprises at least one set of nip rollers having a driven roller directed parallel to said reference surface and a backup roller canted toward said reference surface.

4. The sheet feed apparatus as in claim 1 in which said driven feed apparatus comprises at least one set of nip rollers having a driven roller directed parallel to said reference surface and a backup roller canted toward said reference surface.

* * * * *